US005272951A

United States Patent [19]

Cohen

[11] Patent Number: 5,272,951

[45] Date of Patent: Dec. 28, 1993

[54] TUBE SHEKERE

[75] Inventor: Wayne E. Cohen, Cliffside Park, N.J.

[73] Assignee: Latin Percussion, Garfield, N.J.

[21] Appl. No.: 12,597

[22] Filed: Feb. 3, 1993

[51] Int. Cl.[5] ..... G10D 13/08

[52] U.S. Cl. ..... 84/402; 446/419

[58] Field of Search ..... 84/402, 411 R; 446/418, 446/419

[56] References Cited

U.S. PATENT DOCUMENTS 3,521,518 7/1968 Cohen ..... 84/402

OTHER PUBLICATIONS

Photograph of a percussion device.

CP Percussion Catalog, 1991-1992, p. 14 (Item #CP247).

LP Catalog, 4th Printing, p. 45 (Item #'s: LP316, LP590, LP426, LP480, LP483).

*Primary Examiner*—Michael L. Gellner

*Assistant Examiner*—Patrick Stanzione

*Attorney, Agent, or Firm*—Brumbaugh, Graves, Donohue & Raymond

[57] ABSTRACT

A percussion instrument is formed from a hollow cylindrical tube which is provided with a surrounding beaded net. The net is mounted by passing net end strands into a circumferential ring of radial boreholes adjacent each end of the tube and outward through the tube ends.

4 Claims, 1 Drawing Sheet

TUBE SHEKERE

BACKGROUND OF THE INVENTION

The present invention relates to a new percussion instrument. The instrument resembles a conventional shaker which usually includes beads on the inside of a cylinder.

Previously known instruments include a shekere which has externally mounted beaded net for producing a musical sound. It is an object of the present invention to provide an attractive percussion instrument which provides a beaded rattle sound and which can be played in a variety of modes by a musician.

SUMMARY OF THE INVENTION

According to the invention there is provided a percussion instrument comprising a hollow cylindrical tube having closed ends and having first and second circumferential rings of radial boreholes adjacent each end and an axial borehole in each closed end. A beaded net surrounds the tube and has net end strands which pass into the radial boreholes and extend out from the axial boreholes to form extended tassels at each end of the tube.

The instrument preferably includes grommets in the radial boreholes and is fabricated of metal. The beaded net preferably has glass beads.

For a better understanding of the present invention together with other objects, reference is made to the following description, taken in conjunction with the accompanying drawings, and its scope will be pointed out in the appended claims.

DESCRIPTION OF THE PREFERRED EMBODIMENT

Figure 1:
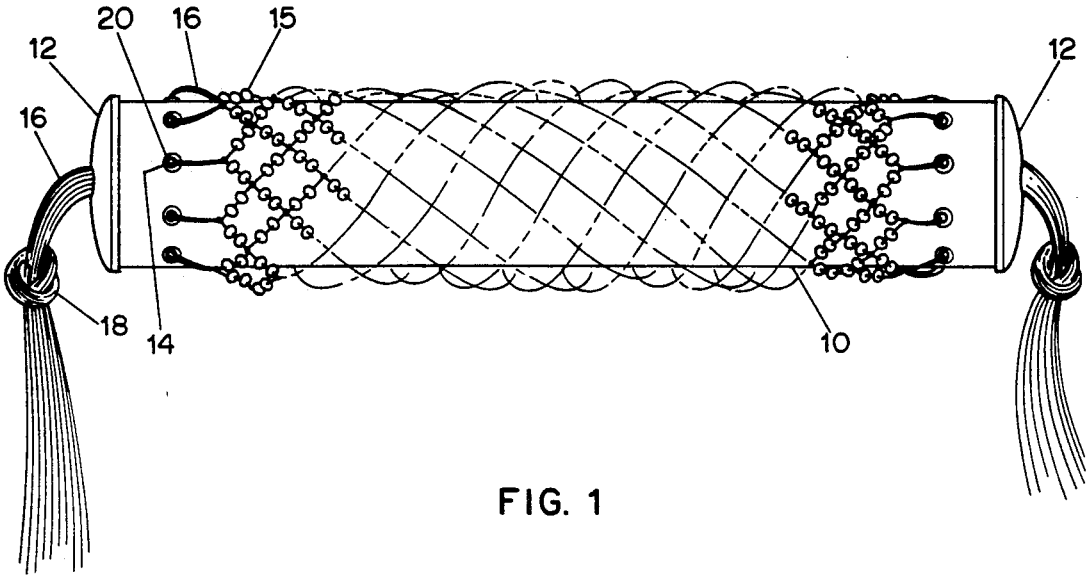
FIG. 1 is a plan view of a tube shekere in accordance with the present invention.

The instrument of the present invention, as shown in FIG. 1 includes a hollow metal tube 10 which may be fabricated of aluminum or steel. Plastic or wood may also be used and will provide different musical tones, but greater wall thickness may be needed. Tube 10 is relatively thin walled, i.e., in the range of 1/32 inches thick. It is provided with end caps 12, which overlap the cylindrical tube for attachment, and preferably have a slightly spherical bulge from the ends of the cylindrical tube 10. Tube 10 is provided with two circumferential rings of radial boreholes 14, one adjacent each end of the tube. In a preferred embodiment tube 10 has a diameter of 3 inches and a length of 18 inches. Boreholes 10 are provided approximately 1 inch from each end. Ten bore holes 14 are preferably spaced around the circumference of tube 10.

Figure 2:
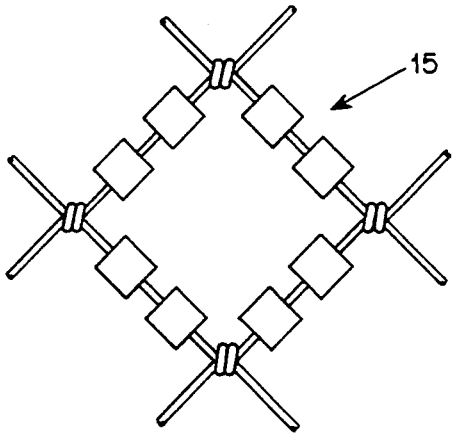
FIG. 2 is a detailed view of a portion of the beaded net used in the instrument of FIG. 1.

A beaded net 15 made, for example, of nylon cord and glass beads surrounds tube 10 and has net end strands 16 which pass into the tube through the radial boreholes 14 and out of the tube through the axial bore in the end cap 12. A preferred net arrangement for the beaded net 15 is shown in FIG. 2, but other arrangements may also be used.

When tube 10 is held horizontally, with one hand at each tube end, the beaded net tends to hang loosely from the bottom of tube 10. Accordingly, by shaking tube 10 transversely to the axis of tube 16 the beaded net will rhythmically rattle against tube 10. The amount of clearance between the beaded net 15 and tube 10 can be adjusted by adjusting the tension on the net end strands, by pulling the strand ends through the axial bore hole of the end cap 12 and providing an external knot 18 to retain them in the desired tension condition.

In another mode of play, again holding the instrument in a horizontal orientation, axial shaking of tube 10 will cause the beaded net to shift axially along the tube making a different rhythmic musical sound.

Boreholes 14 are preferably provided with rubber grommets 20 which provide vibration insulation between the nylon net strands and tube 10, and also prevent abrasion and wear on the net end strands at the point they enter the instrument.

While there has been described what is believed to be the preferred embodiment of the invention, those skilled in the art will recognize that other and further modifications may be made thereto without departing from the spirit of the invention, and it is intended to claim all such changes and modifications as fall within the true scope of the invention.

I claim:

1. A percussion instrument comprising a hollow cylindrical tube having closed ends and having first and second circumferential rings of radial boreholes adjacent each end, an axial borehole in each closed end, and a beaded net surrounding said tube and having net end strands passing into said radial boreholes and extending out from said axial boreholes to form extended tassels at each end of said tube.

2. A percussion instrument as specified in claim 1 wherein there are provided grommets in said radial boreholes.

3. A percussion instrument as specified in claim 1 wherein said tube is metal.

4. A percussion instrument as specified in claim 1 wherein said beaded net includes glass beads.

* * * * *